US005979380A

United States Patent [19]

Nakadouzono et al.

[11] Patent Number: 5,979,380

[45] Date of Patent: Nov. 9, 1999

[54] VALVE TIMING CONTROL DEVICE

[75] Inventors: Hiroyuki Nakadouzono; Kazumi Ogawa; Katsuhiko Eguchi; Kongo Aoki; Naoki Kira, all of Aichi-pref., Japan

[73] Assignee: Aisin Seiki Kabushiki Kaisha, Aichi-pref., Japan

[21] Appl. No.: 08/899,161

[22] Filed: Jul. 23, 1997

[30] Foreign Application Priority Data

| | | | |
|---|---|---|---|
| Jul. 23, 1996 | [JP] | Japan | 8-193615 |
| Jul. 31, 1996 | [JP] | Japan | 8-202288 |
| Sep. 30, 1996 | [JP] | Japan | 8-259304 |

[51] Int. Cl.[6] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,450,825 | 9/1995 | Geyer et al. | 123/90.17 |
| 5,520,145 | 5/1996 | Nagai et al. | 123/90.17 |

*Primary Examiner*—Weilun Lo
*Attorney, Agent, or Firm*—Hazel & Thomas, P.C.

[57] ABSTRACT

A valve timing control device includes a rotor fixed on a cam shaft, a housing member rotatably mounted on the cam shaft so as to surround the rotor, a chamber defined between the housing member and the rotor and having a pair of circumferentially opposed walls, a vane mounted on the rotor and extended outwardly therefrom in the radial direction into the chamber so as to divide each of chamber into a first pressure chamber and a second pressure chamber, a fluid supplying device for supplying fluid under pressure to at least a selected one of the first pressure chamber and the second pressure chamber, a locking mechanism for connecting the housing member and the rotor and a canceling device for canceling the locking mechanism and for keeping the locking mechanism canceling by the fluid pressure of the fluid supplying device.

3 Claims, 11 Drawing Sheets

VALVE TIMING CONTROL DEVICE

BACKGROUND OF THE INVENTION

1. Field of the Invention

The present invention relates to a valve timing control device and, in particular, to a valve timing control device for controlling an angular phase difference between a crank shaft of a combustion engine and a cam shaft of the combustion engine.

2. Description of the Prior Art

In general, a valve timing of a combustion engine is determined by valve mechanisms driven by cam shafts according to a characteristic of the combustion engine or an use of the combustion engine. Since a condition of the combustion is changed in response to the rotational speed of the combustion engine, however, it is difficult to obtain an optimum valve timing through the whole rotational range. Therefore, a valve timing control device which is able to change a valve timing in response to the condition of the combustion engine is proposed as an auxiliary mechanism of the valve mechanism in recent years.

A conventional device of this kind is disclosed, for example, in U.S. Pat. No. 4,858,572. An shown in FIG. 13 and FIG. 14, this device includes a rotor 3 which is fixed on the cam shaft 4 rotatably supported on a cylinder head 14 of the engine, a drive pulley 1 which is driven by the rotational torque from a crank shaft (not shown) and which rotatably mounted on the cam shaft 4 so as to surround the rotor 3, a plurality of chambers 8 which are defined between the drive pulley 1 and the rotor 3 and each of which has a pair of circumferentially opposed walls 1*a*, 1*b* and a plurality of vanes 2 which are mounted to the rotor 3 and which is extended outwardly therefrom in the radial direction into the chambers 8 so as to divide each of chambers 8 into a first pressure chamber 9 and a second pressure chamber 9*b*. Each of the vanes 2 is provided with two hole 2*a*, 2*b* in which coil springs 25*a*, 25*b* are disposed therein so as to urge each of the vanes outwards in the radial direction. An outer plate 5 is fixed to the cam shaft 4 via a plate 21 by a bolt 20 so as to define the chambers 8 with the cam shaft 4 and the drive pulley 1 and so as to locate the vanes 2 in the axial direction. In this device, a fluid under pressure is supplied to a selected one of the first pressure chamber 9 and the second pressure chamber 9*a* by a control valve 15 in response to the running condition of the combustion engine and an angular phase difference between the crank shaft and the cam shaft 4 is controlled so as to advance or retard the valve timing relative to the crank shaft. The control valve 15 has a solenoid 13, a spring 16 and a valve spool 18 and operates in response to the current supplied to the solenoid 13 so that the fluid under pressure is supplied from an oil pump (not shown) to a passage 10 or a passage 11. The passage 10 is communicated with the first pressure chamber 9 and the passage 11 is communicated with the second pressure chamber 9*a*. When the fluid is supplied to the first pressure chamber 9 via the passage 10 by the control valve 15, the vanes 2 and the cam shaft 4 are rotated clockwise relative to the drive pulley 1 and the valve timing is advanced relative to the crank shaft. When the fluid is supplied to the second pressure chamber 9*a* via the passage 11 by the control valve 15, the vanes and the cam shaft 4 are rotated counterclockwise relative to the drive pulley 1 and the valve timing is retarded relative to the crank shaft.

The valve timing control device is in the position of the maximum advanced condition, when each of the vanes 2 contacts with the opposed wall 1*a* of each of the chambers 8. On the other hand, the valve timing control device in the position of the maximum retarded condition, when each of vanes 2 contacts with the opposed wall 1*b* of each of the chambers 8. A radial hole 1*c* is formed on the drive pulley 1 and a first lock pin 22 which is urged inward by a spring 23 is slidably fitted into the radial hole 1*c*. A radial hole 24 is formed on the rotor 3 so as to align with the radial hole 1*c* when the valve timing control device is in the position of the maximum retarded condition. Further, a radial hole 1*d* is formed on the drive pulley 1 and a second lock pin 22*a* which is urged inward by a spring 23*a* in slidably fitted into the radial hole 1*d*. A radial hole 24*a* is formed on the rotor 3 so as to align with the radial hole 1*d* when the valve timing control device is in the position of the maximum advanced condition.

When fluid pressure supplied to the chambers 8 from the oil pump (not shown) is not sufficiently high at the starting of the engine and so on, when the rotational torque is transmitted to the drive pulley, the walls 1*b* of the drive pulley 1 come into collision with the vanes 2 and noise is generated. In the above prior device, the relative rotation between the rotor 3 and the drive pulley 1 is prevented at the maximum advanced condition and the maximum retarded condition by the lock pins 22, 22*a*. Thereby, the generation of the above noise is prevented. However, the lock pins 22, 22*a* repeat the fit into the radial holes 24, 24*a* and the release from the radial holes 24, 24*a* every time the valve timing control device is in the position of the maximum advanced condition or the maximum retarded condition during the engine running. Therefore, the durability of the lock pins 22, 22*a* are decreased and the reliability of the valve timing control device is decreased.

SUMMARY OF THE INVENTION

It is, therefore, an object of the present invention to provide an improved valve timing control device which overcome the above drawbacks.

It is another object of the present invention to provide an improved valve timing control device which can improve its reliability.

In order to achieve these objective, there is provided an improved valve timing control device which includes a rotor fixed on a cam shaft, a housing member rotatably mounted on the cam shaft so as to surround the rotor, a chamber defined between the housing member and the rotor and having a pair of circumferentially opposed walls, a vane mounted on the rotor and extended outwardly therefrom in the radial direction into the chamber so as to divide each of chamber into a first pressure chamber and a second pressure chamber, a fluid supplying means for supplying fluid under pressure to at least a selected one of the first pressure chamber and the second pressure chamber, a locking means for connecting the housing member and the rotor and a canceling means for canceling the locking means and for keeping the locking means canceling by the fluid pressure of the fluid supplying means.

BRIEF DESCRIPTION OF THE DRAWINGS

Additional objects and advantages of the present invention will become more apparent from the following detailed description of a preferred embodiment thereof when considered with reference to the attached drawings, in which.

DESCRIPTION OF THE PREFERRED EMBODIMENTS

A valve timing control device in accordance with preferred embodiments of the present invention will be described with reference to attached drawings.

FIGS. 1 through 4 show a first embodiment of the present invention. In this first embodiment, a valve timing control device according to the present invention is applied to an engine of DOHC (Double Over Head Cam Shaft) type.

Figure 1:
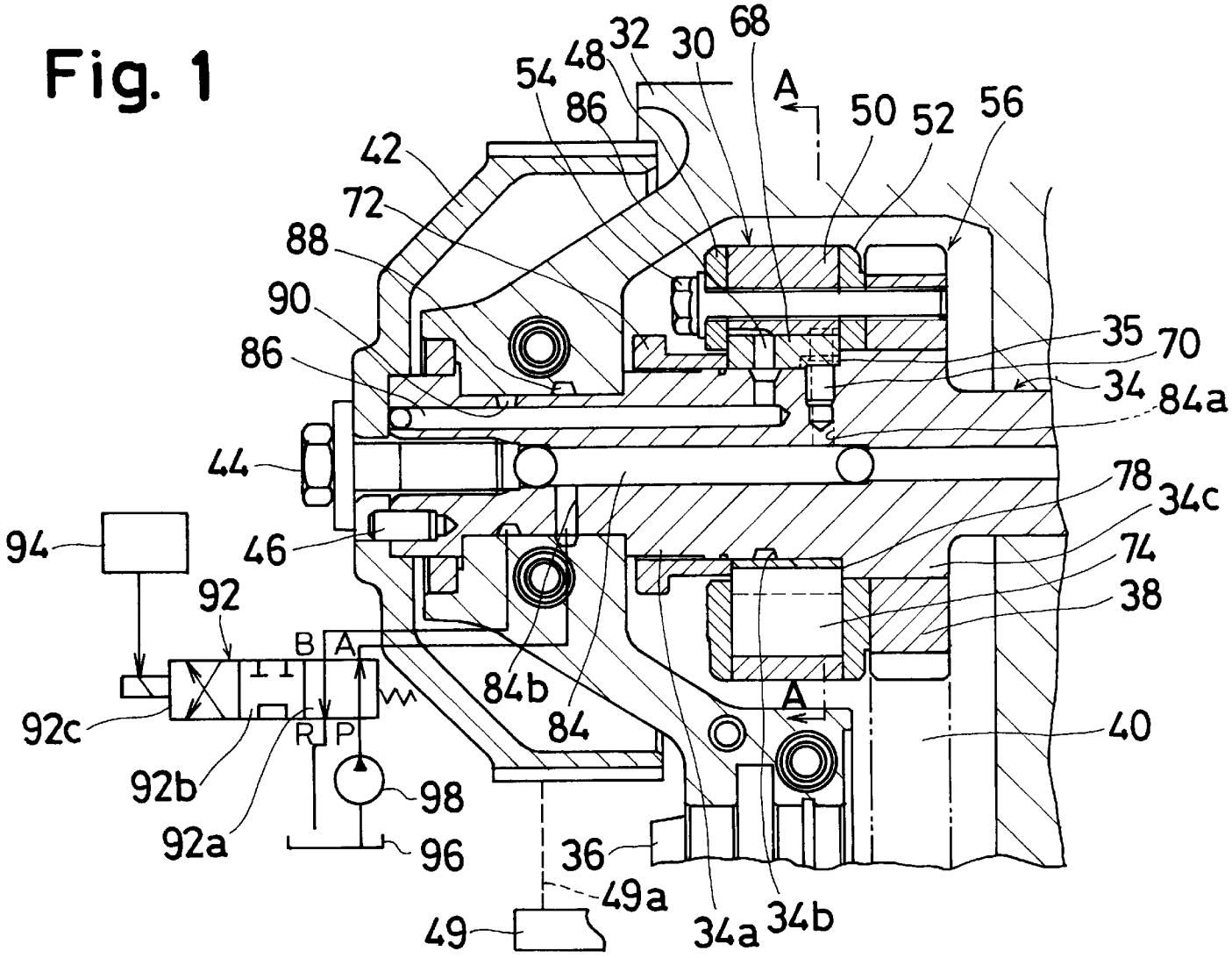
FIG. 1 shows a sectional view of a first embodiment of a valve timing control device in accordance with the present invention.

Referring to FIG. 1, an exhaust cam shaft 34 (a first cam shaft) and an intake cam shaft 36 (a second cam shaft) are rotatably mounted on a cylinder head 32 of an engine and are connected each other by a rotational torque transmitting means 56. The rotational torque transmitting means 56 is comprised of a gear 38 which is rotatably mounted on the exhaust cam shaft 34 and a gear 40 which is fixedly mounted an the intake cam shaft 36.

An end of the exhaust cam shaft 34 is projected out of the cylinder head 32 and a timing pulley 42 is fixed to this protecting and of the exhaust cam shaft 34 by a bolt 44. A stopper pin 46 is fixed to the protecting end of the exhaust cam shaft 34 and is fitted into a notch formed on the timing pulley 42 so that the relative rotation between the timing pulley 42 and the exhaust cam shaft 34 is prevented. Rotational torque is transmitted to the timing pulley 42 via a belt 49*a* from a crank shaft 49 which is rotated by the engine.

A cylindrical portion of the exhaust cam shaft 34 which is extended into the cylinder head 32 is provided with a male screw portion 34*a* on which a male screw is formed and a passage portion on which a circular groove 34*b* is formed in order from a front side (left side in FIG. 1). At the adjacent portion of the passage portion (at the right side of the passage portion in FIG. 1), a journal portion 34*c* having a larger diameter than that of the passage portion is formed and a plurality of cam portions (not shown) are continuously formed at the right side of the journal portion 34*c*. On the journal portion 34*c*, the gear 38 having three female screw holes which are penetrated in the axial direction which are separated in the circumferential direction at regular intervals is rotatably mounted thereon.

Figure 2:
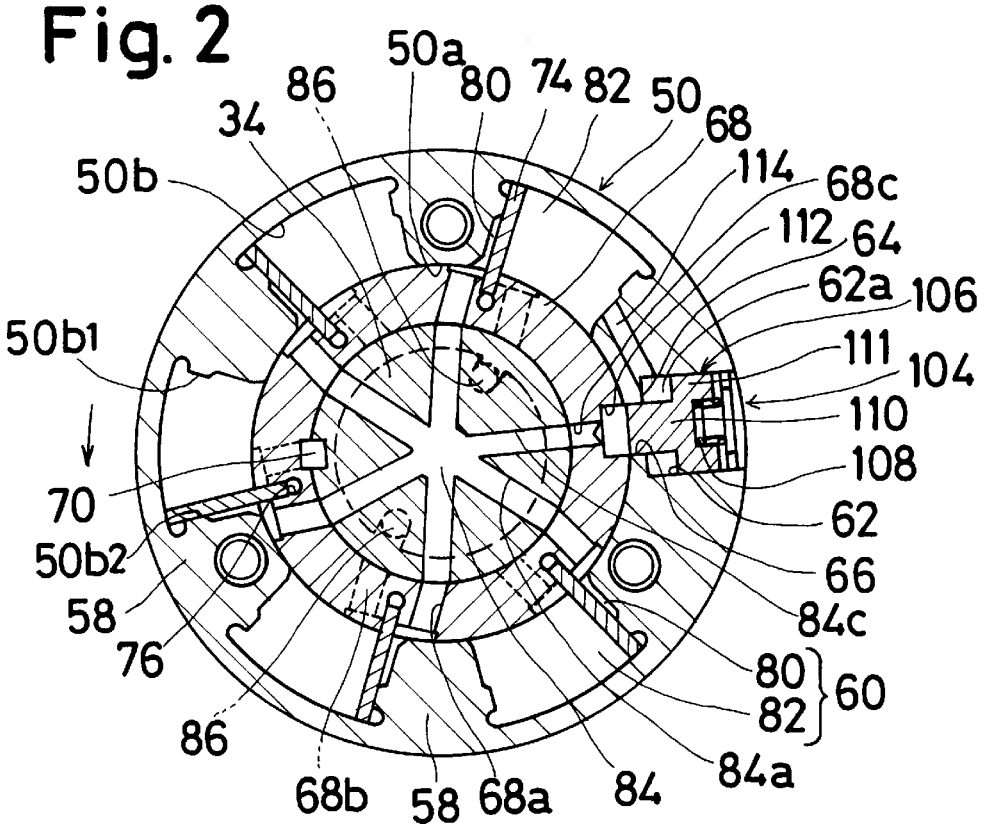
FIG. 2 shows a cross-sectional view taken on line A—A a FIG. 1 and shows a maximum retarded condition thereof at the running of an engine.
Figure 3:
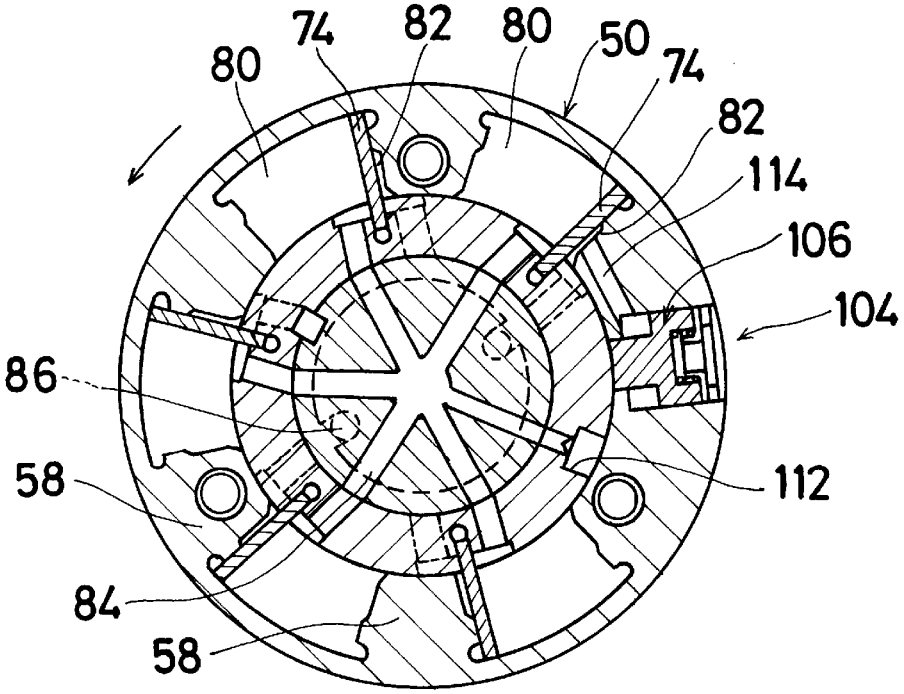
FIG. 3 shows a cross-sectional view taken on line A—A of FIG. 1 and shows a maximum advanced condition thereof at the running of an engine.
Figure 4:
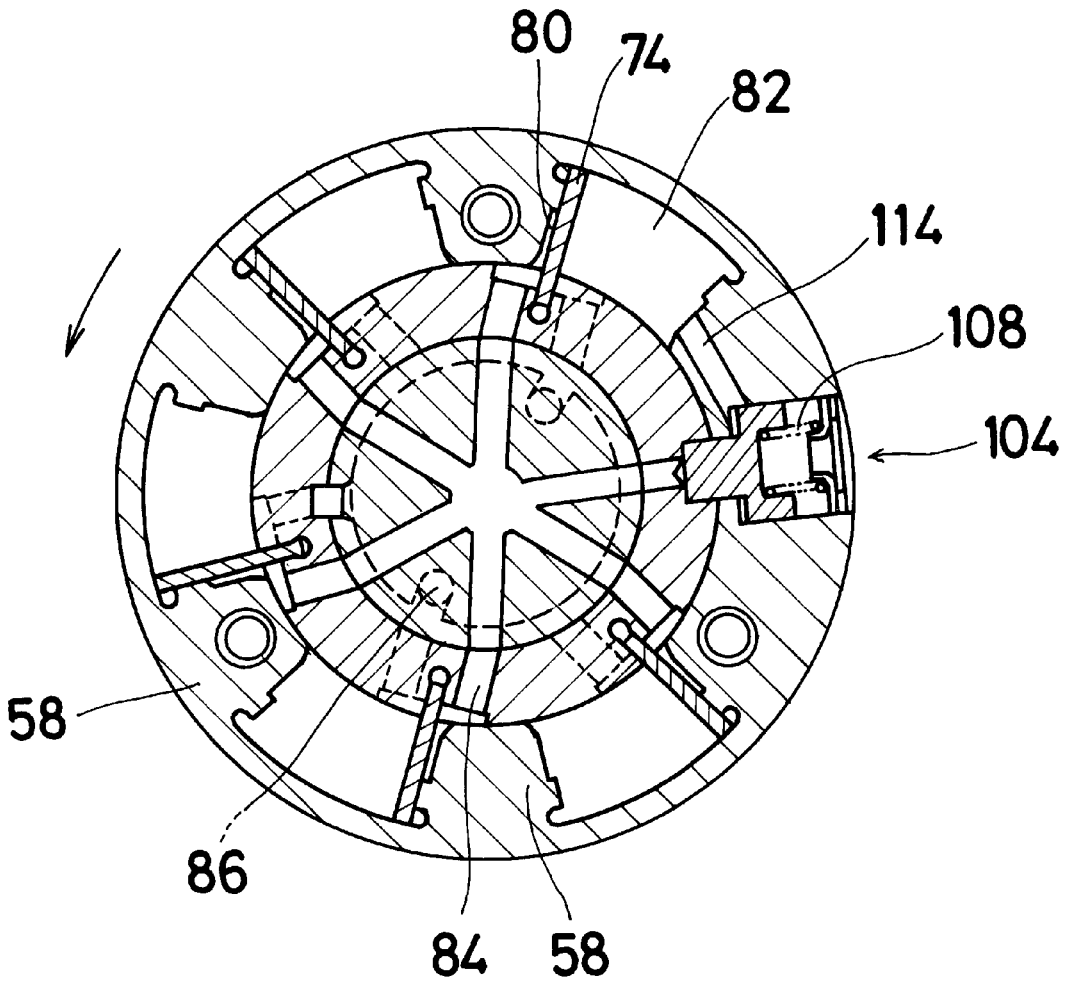
FIG. 4 shows a cross-sectional view taken on line A—A of FIG. 1 and shows as maximum retarded condition thereof at the starting of an engine.

On the passage portion of the exhaust cam shaft 34, a valve timing control mechanism 30 is mounted thereon. As shown in FIG. 2 to FIG. 4, the valve timing control mechanism 30 includes a rotor 68, five vanes 74, a housing member 50, a circular front plate 48 and a circular rear plate 52. The rotor 68 has a cylindrical shape and is fixedly mounted on the passage portion of the exhaust cam shaft 34 by a pin 70. The pin 70 is pressed in the passage portion of the exhaust cam shaft 34 in the radial direction and is fitted into a notch portion 35 formed on the inner circumferential portion of the rotor 68 so that the relative rotation between the rotor 68 and the exhaust cam shaft 34 is prevented. The housing member 50 has a cylindrical shape having an inner bore 50*a* and is rotatably mounted on the outer circumferential surface of the rotor 68 so as to surround the rotor 68. The housing member 50 has the same axial length as the rotor 68 and is provided with five grooves 50*b* which are outwardly extended from the inner bore 50*a* in the radial direction and which are separated in the circumferential direction. The housing member 50 is also provided with three holes which penetrate in the axial direction and which are separated in the circumferential direction at regular intervals. The rear plate 52 is rotatably mounted on the journal portion 34*c* so as to locate between the gear 38 and one side face of the housing 50 and the rotor 68, and is provided with three holes which penetrate in the axial direction and which are separated in the circumferential direction at regular intervals. The front plate 48 is located so as to be opposite to the other side faces of the housing member 50 and the rotor 68, and is provided with three holes which penetrate in the axial direction and which are separated in the circumferential direction at regular intervals. Three bolts 86 are fitted into the holes of the front plate 48, the housing member 50 and the rear plate 52, and are screwed into the female screw holes of the gear 38. Thereby, the front plate 48 is fluid-tightly pressed to the other side face of the housing 50 and the rear plate 52 is fluid-tightly pressed to one side face of the housing 50. Now, one side face of the rotor 68 is in contact with a stepped portion of the journal portion 34*c* and under this condition a nut 72 is screwed onto the male screw portion 34*a* of the exhaust cam shaft 34 so as to press the rotor 68 toward the journal portion 34*c*. Thereby, rotor 68 is rotated with the exhaust cam shaft 34 as a single body.

Thereby, five chambers 60 which are separated in the circumferential direction at regular intervals and each of which has a pair of circumferentially opposed walls 50*b*1,

50*b*2 are defined among the rotor 68, the housing member 50, the front plate 48 and the rear plate 52. On the outer circumferential portion 5 of the rotor 68, five grooves 76 which extend inwardly therefrom in the radial direction and which are separated in the circumferential direction are formed thereon. Five vanes 74 which extend outwardly in the radial direction into the chambers 60 are mounted in the grooves 76, respectively. Thereby, each of chambers 60 is divided into a first pressure chamber 80 and a second pressure chamber 82, both of which are fluid-tightly separated from each other. A plate spring (not shown) is interposed between the bottom of the groove 76 and the vane 74, and thereby the vanes 74 are normally urged outwards.

The rotor 68 is provided with five first passages 68*a* and five second passages 68*b*. One end of each of the first passages 68*a* communicates with each of radial holes 84*a* and the other and of each of the first passages 68*a* communicates with each of the first pressure chambers 80. On the other hand, one end of each of the second passages 68*b* communicates with the circular groove 34*b* and the other end of each of the second passages 68*b* communicates with each of the second pressure chambers 82. Each of the radial holes 84*a* extends radially and outwardly from a passage 84, which is formed in the exhaust cam shaft 34 at its axial center and which extends in the axial direction. The circular groove 34*b* communicates with a pair of passages 86 which are formed in the exhaust cam shaft 34 so as to be located on the coaxial circle about the axial center of the shaft 34, and which extend in parallel in the axial direction.

A portion which is located between the cylindrical portion and the projecting end portion of the exhaust cam shaft 34 is rotatably supported on the cylinder head 32 and a cover (not shown) and is provided with a circular groove 90. The circular groove 90 communicates with the passages 86. The supporting surfaces of the cylinder head 32 and the cover (not shown) for supporting the exhaust cam shaft 34 is provided with a circular groove 88. The circular groove 88 communicates with the passage 84 via a passage 84*b*.

A fluid supplying device is comprised of a changeover valve 92, a fluid pump 98 and a controller 94. In this embodiment the changeover valve 92 is an electromagnetic valve which is a 4 port—3 position type. The fluid pump 98 is driven by the engine and discharges the fluid (=oil) for lubricating the engine. The pump 98 may be a pump for lubricating the engine. The circular groove 88 communicates with to an A port of the changeover valve 92 and the circular groove 90 communicates with to a B port of the changeover valve 92. A port P of the changeover valve 92 communicates with a discharge portion of the fluid pump 98 and a R port of the changeover valve 92 communicates with a reservoir 96. The position of the changeover valve 92 is controlled by the controller 94 so that a first condition 92*a* in which the discharged fluid from the pump 98 is supplied to the circular groove 88 and in which the circular groove 90 communicates with the reservoir 96, a second condition 92*b* in which the communication between the circular grooves 88, 90 and the pump 98 and the reservoir 96 are interrupted, respectively and in which the discharged fluid from the pump 98 is supplied to the reservoir 96 and a third condition 92*c* in which the discharged fluid from the pump 98 is supplied to the circular groove 90 and in which the circular groove 88 communicates with the reservoir 96 are selectively obtained. The controller 94 controls the above conditions of the changeover valve 92 based on parameter signals which characterize the engine speed, the amount of opening of a throttle valve (not shown) and so on.

A locking mechanism 104 is disposed between the rotor 68 and the housing member 50. The looking mechanism 104 includes a receiving hole 112 which is formed on the outer circumferential portion of the rotor 68, a stepped canceling hole 62 which is formed on the inner circumferential portion of the housing member 50 so as to be able to align with the receiving hole 112 and a stepped locking pin 106 which is slidably fitted into the canceling hole 62. The canceling hole 62 has a stepped portion 64 and a small diameter portion 66 which is opened into the inner circumference of the housing member 50 and whose diameter is the same as that of the receiving hole 112. In the radially outer end portion of the canceling hole 62, a snap ring and a retainer are fixed therein and a spring 108 is disposed between the retainer and the locking pin 106 so as to urge the locking pin 106 inwardly. The locking pin 106 has a small diameter portion 110 whose outer diameter is nearly same as the diameter of the small diameter portion 66 of the canceling hole 62 and a large diameter portion 111. Thereby, the small diameter portion 110 of the locking pin 106 can be fitted into the small diameter portion 66 of the canceling hole 62 and the receiving hole 112 by the spring 108 when the receiving hole 112 is aligned with the canceling hole 62 at the maximum retarded condition. The receiving hole 112 is communicated with the passage 84 via a radial hole 84*c* and a radial hole 68*c* which are formed on the cam shaft 34 and the rotor 68, respectively. Further, a circular space, 62*a* which is formed between the large diameter portion 111 of the locking pin 106 and the stepped portion 64 of the canceling hole 62 is communicated with the adjacent second pressure chamber 82 via as passage 114 which is formed on the housing member 50.

The operation of the valve timing control device having the above structure will now be described.

With the starting of the engine, the exhaust cam shaft 34 is rotated counterclockwise by the timing pulley 42 in FIG. 2. Thereby, exhaust valves (not shown) are opened and closed. Simultaneously, the rotor 68 is rotated and then gear 38 is rotated via the vanes 74, the housing member 50 and the bolts 54. The rotation of the gear 38 is transmitted to the gear 40 and then the intake cam shaft 36 is rotated so that intake valves (not shown) are opened and closed. At this time, the pressure in the chambers 60 decreases during the stop of the engine and therefore it takes a predetermined time to increase the pressure in the chambers 60 by the pressurized fluid from the oil pump 98 after the starting of the engine. Therefore, the rotor 68 is rotated relative to the housing member 50 until the maximum retarded condition in which the each of the vanes 74 contacts with each of the opposed wall 50*b*2 shown in FIG. 2 and FIG. 4. When the rotor 68 is rotated relative to the housing member 50 until the maximum retarded condition and the receiving hole 112 is aligned with the canceling hole 62, the small diameter portion 110 of the locking pin 106 is fitted into the receiving hole 112 by the spring 108 as shown in FIG. 4 and the rotor 68 and the housing member 50 are connected with each other. Thereby, the vanes 74 are prevented from colliding with the housing member 50 by variations in the torque acting on the cam shaft 34, and the generating of noise is prevented. Now, at this time, the changeover valve 92 is in the first condition 92*a*.

When the pressure of the fluid discharged from the oil pump 98 becomes sufficiently high and the changeover valve 92 is changed to the first position, the pressurized fluid is supplied to the first chambers 80 and simultaneously to the receiving hole 112. Thereby, the locking pin 106 is pushed out from the receiving hole 112 against the urging force of the spring 108 as shown in FIG. 2, and relative rotation between the housing member 50 and the rotor 68 is allowed.

Then, the housing member 50, the front plate 48 and the rear plate 52 are rotated counterclockwise with the gear 38 relative to the rotor 68 by the pressure in the first pressure chambers 80 until the maximum advanced condition in which the vanes 74 contact with the opposed walls 50*b*1, respectively as shown in FIG. 3 and in which the angular phase of the intake cam shaft 36 is advanced relative to that of the exhaust cam shaft 34 (=the crank shaft 49) to a maximum value. In this condition, when the pressurized fluid is supplied from the pump 98 to the second pressure chambers 82 by the changeover valve 92 changed to the third condition, the housing member 50, the front plate 48 and the rear plate 52 are rotated clockwise with the gear 38 relative to the exhaust cam shaft 34 in FIG. 3. Thereby, the valve timing control mechanism is in the position of the maximum retarded condition in which the vanes 78 are in contact with the walls 50*b*2 and in which the angular phase of the intake cam shaft 36 is retarded relative to that of the exhaust cam shaft 34 (=the crank shaft 49) by a maximum value from the above mentioned maximum advanced condition as shown in FIG. 2.

At that time, although the pressure in the receiving hole 112 is decreased, the pressure in the adjacent second pressure chamber 82 is applied to the circular space 62*a*. Therefore, the locking pin 106 is in the condition in which the small diameter portion 110 is pushed out from the receiving hole 112, Now, depending on the manner in which the control of the changeover valve 92 is executed, the vanes 74 can be stopped in any position (intermediate advanced position) between the maximum advanced position and the maximum retarded position. This requires that a balance be achieved between the fluid pressure of the first pressure chambers 80 and the fluid pressure of the second pressure chambers 82 when the vanes 74 have achieved an arbitrary position. The amount of the advance can therefore be set to any value between a zero level and a maximum level.

As mentioned above, the opening and closing timing of the intake valves (not shown) driven by the intake Cam shaft 36 is adjusted and the angular phase difference between the crank shaft 49 and the intake cam shaft 36 is adjusted.

As mentioned above, according to the first embodiment, the locking pin 106 is pushed out from the receiving hole 112 during the running of the engine or when the supplied fluid pressure from the oil pump 98 is sufficiently high. Only when the engine is started or the supplied fluid pressure from the oil pump 98 is not sufficiently high, the locking pin 106 is fitted into the receiving hole 112. Therefore, the number of operations of the locking pin 106 is remarkably reduced and thereby the durability and the reliability of the locking mechanism 104 is remarkably improved.

Figure 5:
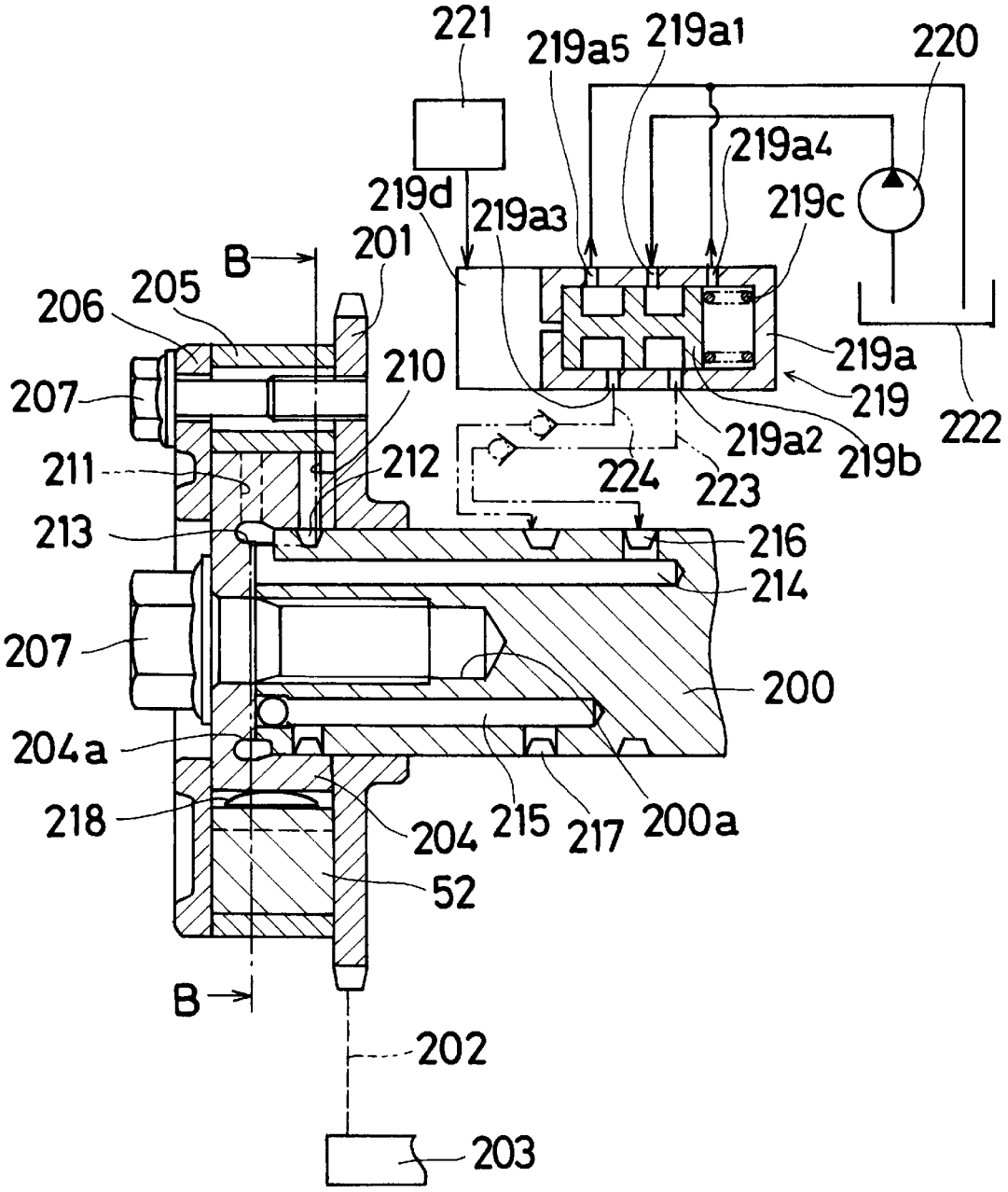
FIG. 5 shows a sectional view of a second embodiment of a valve timing control device in accordance with the present invention.
Figure 6:
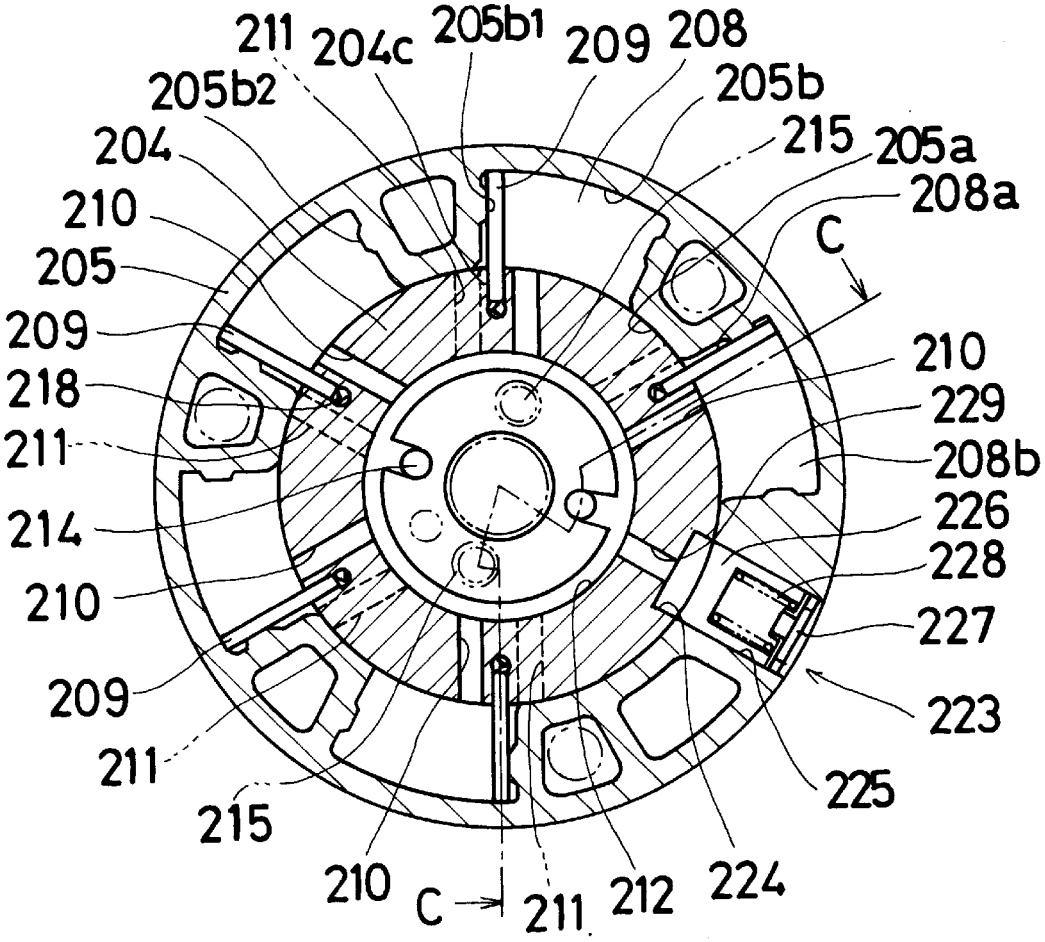
FIG. 6 shows a cross-sectional view taken on line B—B of FIG. 5.
Figure 7:
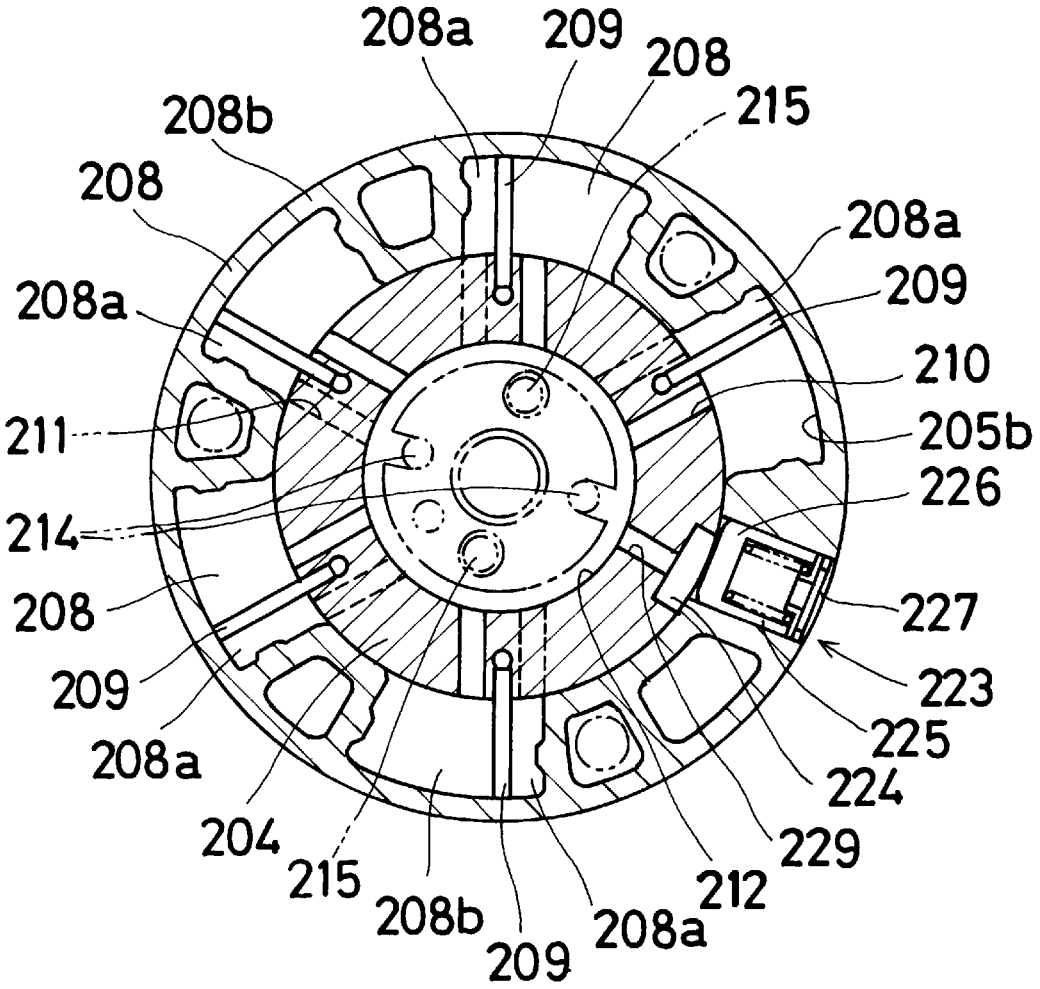
FIG. 7 shows a cross-sectional view showing a condition which is advanced a little from a maximum retarded condition in the second embodiment.

FIGS. 5 through 7 show a second embodiment of the present invention. In FIGS. 5 through 7, the same parts as compared with FIGS. 1 through 4 are identified by the same reference numerals.

Referring to FIGS. 5 through 7, a cam shaft 200 which in provided with a plurality of cam portions (not shown) driving valves (not shown) is rotatably supported on a cylinder head (not shown) of an engine at its plural journal portions. An end of the cam shaft 200 is projected out of the cylinder head and a timing gear 201 is rotatably mounted on this projecting end of the cam shaft 200. Rotational torque transmitted to the timing gear 201 via a chain 202 from a crank shaft 203 which is rotated by the engine. The timing gear 201 is provided with three female screw holes which are penetrated in the axial direction and which are separated in the circumferential direction at regular intervals.

A cylindrical rotor 204 having a stepped inner bore 204*a* is fixedly mounted on the projecting end of the cam shaft 200 by a pin (not shown) so that the relative rotation between the rotor 204 and the cam shaft 200 is prevented. The rotor 204 is fitted onto the projecting end of the cam shaft 200 at its large diameter portion of the stepped inner bore 204*a* and a stepped portion between the large diameter portion and a small diameter portion of the stepped inner bore is contacted with a top surface of the projecting and of the cam shaft 200. One said surface of the rotor 204 is in contact with the flat surface of the timing gear 201. A cylindrical housing member 205 having a inner bore 205*a* is rotatably mounted on the outer circumferential surface of the rotor 204 so as to surround the rotor 204. The housing member 205 has the same axial length as the rotor 204 and is provided with five grooves 205*b* which outwardly extend from the inner bore 205*a* in the radial direction and which are separated in the circumferential direction. The housing member 205 is further provided with three penetrating holes in the axial direction which are separated from each other at regular intervals. One side surface of the housing 205 is in contact with the flat surface of the timing gear 201. A circular front plate 206 which is provided with three penetrating holes in the axial direction separated from each other at regular intervals is disposed adjacent to the other side surfaces of the rotor 204 and the housing member 205. Each of the holes of the front plate 206, each of the holes of the housing member 205 and each of the female screw holes of the timing gear 201 are coaxially arranged with each other and a bolt 207 is fitted into each of the coaxially arranged holes. Each of the bolts 207 is screwed into each of the female screw holes of the timing gear 201. Thereby, the rotor 204, the housing member 205, the timing gear 201 and the front plate 206 are united. The flat surface of the timing gear 201 is fluid-tightly pressed onto one side surface of the rotor 204 and the housing member 205 and one side surface of the front plate 206 is fluid-tightly pressed onto the other side surfaces of the rotor 204 and the housing member 205.

A central screw hole 200*a* which is opened outside and whose diameter is the almost same as that of the front plate 206 are formed at an axial center of the projecting end of the cam shaft 200. A central bolt 207 is screwed into the central screw hole 200*a* and thereby the rotor 204 is fixed to the projecting end of the cam shaft 200.

Thereby, five chambers 208 which are separated in the circumferential direction and each of which has a pair of circumferentially opposed walls 205*b*1, 205*b*2 are defined among the rotor 204, the housing member 205, the front plate 206 and the timing gear 201. On the outer circumferential portion of the rotor 204, five grooves 204*c* which extend inwardly therefrom in the radial direction and which are separated in the circumferential direction are formed thereon. Five vanes 209 which extend outwardly in the radial direction into the chambers 208 are mounted in the grooves 205*c*, respectively. Thereby, each of chambers 208 is divided into a first pressure chamber 208*a* and a second pressure chamber 208*b*, both of which are fluid-tightly separated from each other. Numeral 218 is a plate spring which urges each of the vanes 209 outwardly in the radial direction.

The rotor 204 is provided with five first passages 211 and five second passages 210. One end of each of the second passages 210 communicates with a circular groove 213 which is formed on the large diameter portion of the stepped bore 204*a* of the rotor 204. The other end of each of the second passages 210 communicates with each of the second pressure chambers 208*b*. On the other hand, one and of each of the first passages 211 communicates with a circular groove 212 which is formed on the outer circumferential portion of the projecting end of the cam shaft 200. The other end of each of the first passages 211 communicates with each of the first pressure chambers 208*a*. The circular groove 213 communicates with a pair of grooves which are symmetrically formed with regard to the axial center of the cam shaft 200 on the top surface of the projecting end of the cam shaft 200. The grooves communicate with a pair of passages 214 which are formed on a coaxial circle about the axial center of the cam shaft 200 and which are extended in the axial direction. The circular groove 212 communicates with a pair of passages 215 via a pair of radial passages which are symmetrically formed with regard to the axial center of the cam shaft 200 in the projecting end and which are extended in the radial direction. The passages 214 are formed on the coaxial circle about the axial center of the cam shaft 200 and are separated from the passages 215 in the circumferential direction at a predetermined angle. The passages 215 are extended in the axial direction and a ball is pressed into one and of each passages 215 which is opened toward the stepped portion of the rotor 204.

A pair of circular grooves 216 and 217 are formed on the journal portion of the cam shaft 200. The circular groove 216 communicates with the passages 214. The circular groove 217 communicates with the passages 215.

A fluid supplying device is comprised of a changeover valve 219, a fluid pump 220 and a controller 221. In this embodiment, the changeover valve 219 include a housing 219*a* having five connecting ports 219*a*1 to 219*a*5, a spool 219*b*, a spring 219*c* and a solenoid 219*d*. The spool 219*b* is located in an initial position shown in FIG. 5 when the current is not supplied to the solenoid 219*d* and the spool 219*b* is moved rightward against the spring 219*c* when the current is supplied to the solenoid 219*d* by the controller 221 based on parameter signals characterizing the engine speed, the amount of opening of a throttle valve (not known) and so on. The first connecting port 219*a*1 communicates with the discharged side of the oil pump 220, the second connecting port 219*a*2 communicates with the circular groove 216 via a passage 223, the third connecting port 219*a*3 communicates with the circular groove 217 via a passage 224 and the fourth and fifth connecting ports 219*a*4, 219*a*5 communicate with a reservoir 222. Thereby, the pressurized fluid is supplied from the oil pump 220 to the circular groove 216 when the current is not applied to the solenoid 219*d*. When the current is applied to the solenoid 219*d*, the pressurized fluid is supplied from the oil pump 220 to the circular groove 217.

A locking mechanism 223 is disposed between the rotor 204 and the housing member 205. The locking mechanism 223 includes a receiving hole 224 which is formed on the outer circumferential portion of the rotor 204, a canceling hole 225 whose diameter is almost the same as that of the receiving hole 224 and which is formed on the inner circumferential portion of the housing member 205 so as to be able to align with the receiving hole 224 when the valve timing control device is in a maximum retarded condition and a locking pin 226 which is slidably fitted into the canceling hole 225. The outer end of the canceling hole 225 is closed by a cover 227 having a small hole and a spring 228 is disposed between the locking pin 226 and the cover 227 so as to urge the locking pin 226 inwardly. Thereby, the locking pin 226 can be fitted into the receiving hole 224 by the spring 228 when the receiving hole 224 is aligned with the canceling hole 225 at the maximum retarded condition in which the vanes 209 are in contact with the walls 205*b*1 of the housing member 205 as shown in FIG. 2. The receiving hole 224 communicates with the circular groove 212 via a radial hole 229 which in formed on the rotor 204.

The operation of the valve timing control device having the above structure will now be described.

With the starting of the engine, the cam shaft 200 is rotated clockwise by the timing gear 201 in FIG. 5. Thereby, the housing member 205 is rotated and the rotational torque of the housing member 205 is transmitted to the rotor 204 via the vanes 209. Then, the cam shaft 200 is rotated clockwise in FIG. 5 and the valves (not shown) are opened and closed. At this time, the pressure in the chambers 208 decreases when the engine stops. Therefore, it takes a predetermined time to increase the pressure in the chambers 208 by the pressurized fluid from the oil pump 220 after the starting of the engine. Therefore, the housing member 205 is rotated relative to the rotor 204 until the maximum retarded condition in which the each of the vanes 209 contacts with each of the opposed walls 205*b*1 shown in FIG. 6. When the housing member 205 is rotated relative to the rotor 204 until the maximum retarded condition and the receiving hole 224 is aligned with the canceling hole 225, the locking pin 226 is fitted into the receiving hole 224 by the spring 228 and the rotor 204 and the housing member 205 are connected with each other. Thereby, it is prevented that the vanes 209 come into collision with the housing member 205 by the variation of torque acted on the cam shaft 200 and the generation of the noise is prevented. Now, at this time, the current is applied to the solenoid 219*d* of the changeover valve 219.

When the pressure of the fluid discharged from the oil pump 220 becomes sufficiently high, the pressurized fluid is supplied to the second chambers 208*b* and simultaneously to the receiving hole 224. Thereby, the locking pin 226 is pushed out from the receiving hole 225 against the urging force of the spring 228 as shown in FIG. 5 and the relative rotation between the housing member 205 and the rotor 204 is allowed. Then, when the current supply to the solenoid 219*d* is stopped, the pressurized fluid is supplied to the first chambers 208*a* and thereby the rotor 204 begins to rotate clockwise relative to the housing member 205 as shown in FIG. 7. Then, the rotor 204 is rotated clockwise relative to the housing member 205 until the maximum advanced condition in which the vanes 209 contact with the opposed walls 205*b*2, respectively and in which the angular phase of the cam shaft 200 is advanced relative to that of the crank shaft 203 by a maximum value. In this condition, when the pressurized fluid is supplied from the pump 220 to the second pressure chambers 208*b* by the changeover valve 219, the rotor 204 is rotated counterclockwise relative to the housing member 205. Thereby, the valve timing control mechanism is in the position of the maximum retarded condition in which the varies 209 is contacted with the walls 205*b*1 and in which the angular phase of the cam shaft 200 is retarded relative to that of the crank shaft 203 by maximum value from the above mentioned maximum advanced condition as shown in FIG. 6.

At this time, although the receiving hole 224 is aligned with the canceling hole 225, since the pressurized fluid is supplied to the receiving hole 224, it is prevented the locking pin 226 from fitting into the receiving hole 224 by a damping effect due to the pressurized oil supplied to the receiving hole 224. Now, depending on the manner in which the control of the changeover valve 220 is executed, the vanes 209 can be stopped in any position (intermediate advanced position) between the maximum advanced position and the maximum retarded position. This requires that balance be achieved between the fluid pressure of the first pressure chambers 208*a* and the fluid pressure of the second pressure chambers 208*b* when the vanes 209 have achieved an arbitrary position. The amount of the advance can therefore be set to any value between a zero level and a maximum level.

As mentioned above, the opening and closing timing of the valves (not shown) driven by the cam shaft 200 is adjusted and the angular phase difference between the crank shaft 203 and the cam shaft 200 is adjusted. According to the second embodiment, since the damping effect due to the pressurized fluid supplied to the receiving hole before the receiving hole is aligned with the canceling hole is obtained, the number of operations of the locking pin 226 is remarkably reduced and thereby the durability and the reliability of the locking mechanism 223 is remarkably improved.

Figure 8:
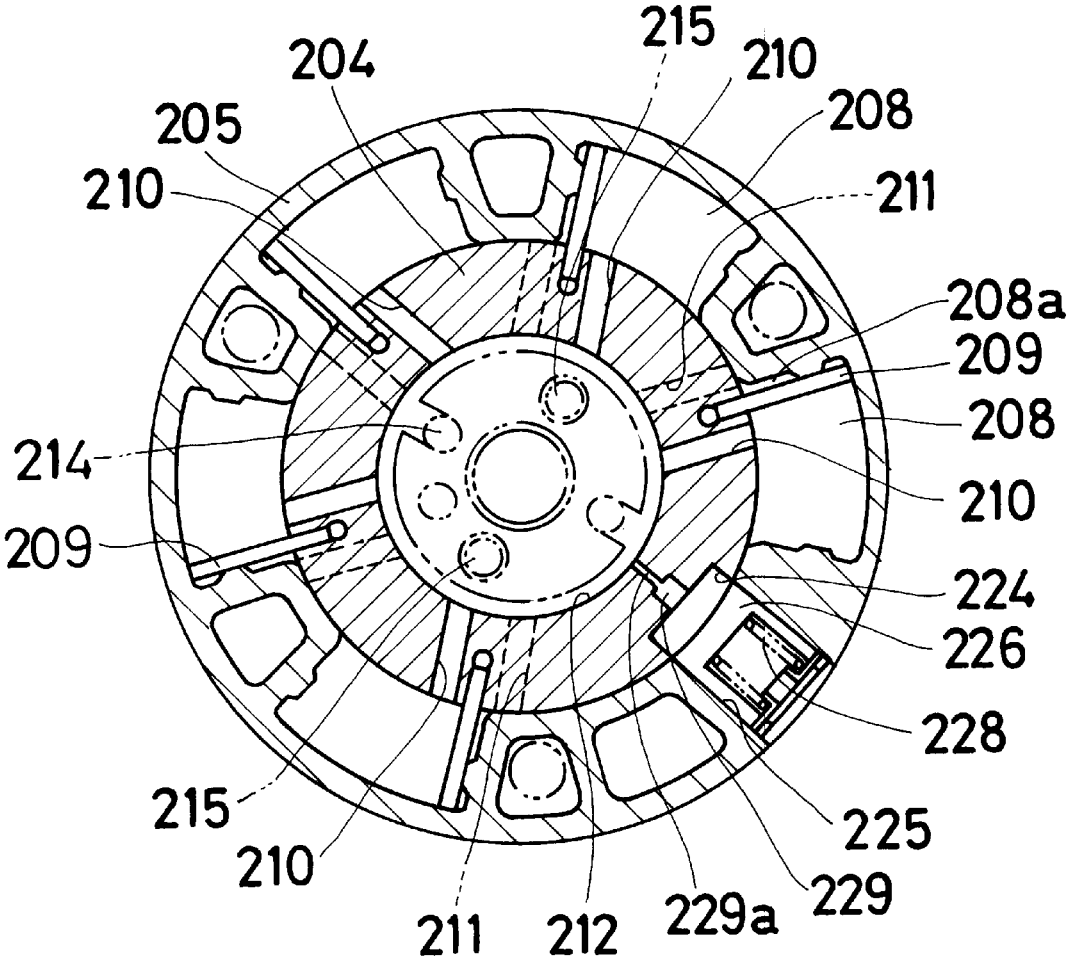
FIG. 8 shows a cross-sectional view of a third embodiment of a valve timing control device in accordance with the present invention.

FIG. 8 shows a third embodiment of the present invention. In FIG. 8, the same parts as compared with FIG. 5 to FIG. 7 are identified by the same reference numerals.

Referring to FIG. 8, an orifice 229*a* is formed in the radial passage 229. According to this embodiment, it is able to store the supplied pressurized fluid in the receiving hole 224. Accordingly, it is able to obtain the same effect as the above second embodiment.

Figure 9A:
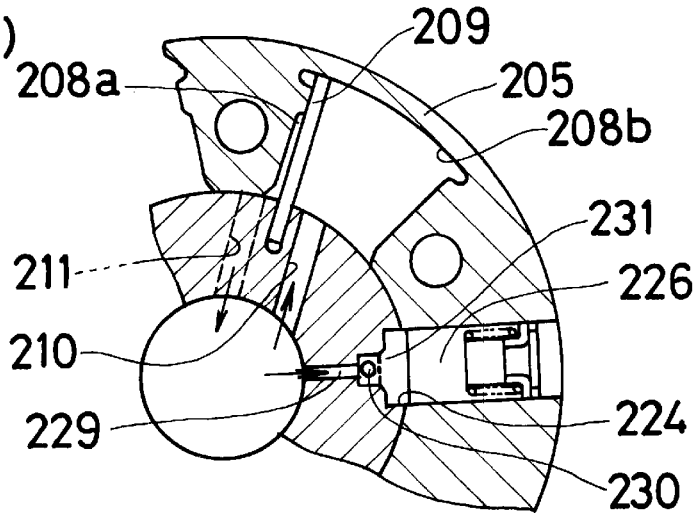
FIG. 9*a* shows a cross-sectional view of a fourth embodiment of a valve timing control device in accordance with the present invention and shows a maximum retarded condition thereof.
Figure 9B:
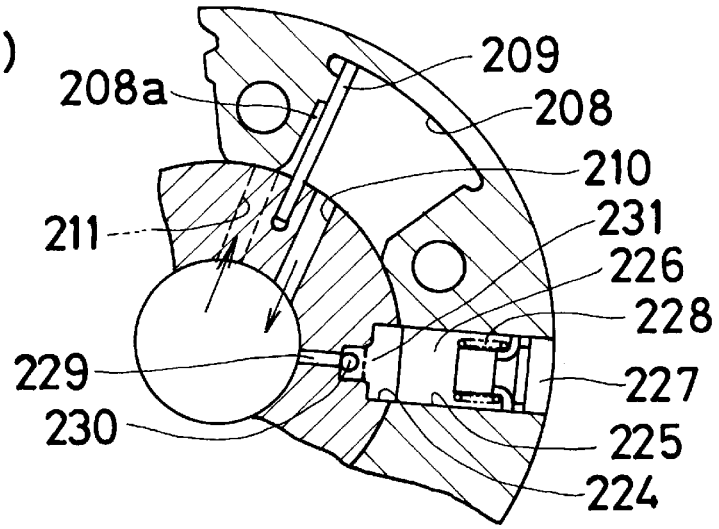
FIG. 9*b* shows a cross-sectional view of a fourth embodiment of a valve timing control device in accordance with the present invention and shows a condition which is changed from a maximum retarded condition to an advanced condition thereof.
Figure 9:
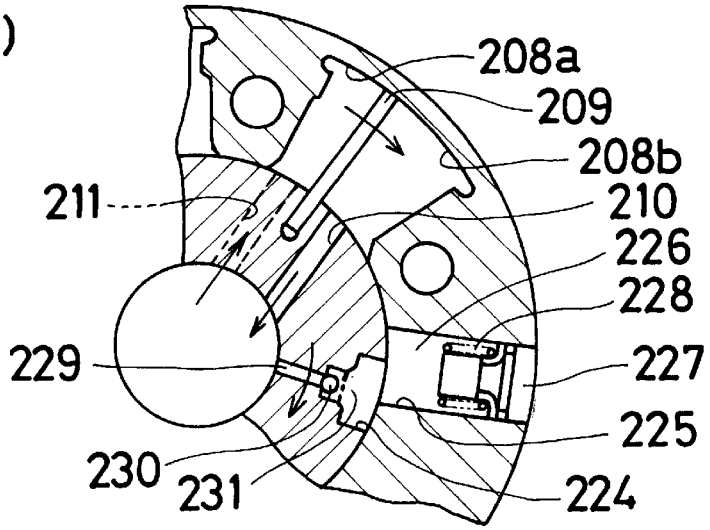
FIG. 9*c* shows a cross-sectional view of a fourth embodiment of a valve timing control device in accordance with the present invention and shows a condition which is advanced a little from a maximum retarded condition.

FIG. 9*a* to FIG. 9*c* show a fourth embodiment of the present invention. In FIG. 9*a* to FIG. 9*c,* the same parts as compared with FIG. 5 to FIG. 7 are identified by the same reference numerals.

Referring to FIG. 9*a* to 9*c,* a small diameter portion is formed on the bottom of the receiving hole 224 and is communicated to the radial passage 229. A checking ball 230 which can close the opening end of the radial passage 229 is disposed in the small diameter portion and a retainer 231 is fixed to the opening end of the small diameter portion. According to this embodiment, since the damping effect due to the pressurized fluid supplied to the receiving hole 224 before the receiving hole 224 is aligned with the canceling hole 225 is obtained, it is able to prevent the locking pin from fitting into the receiving hole 224. FIG. 9*a* shows a maximum retarded condition. In this condition, the pressurized fluid is filled into the receiving hole 224. When the pressure in the second chambers 208*b* is released and the pressurized fluid begins to supply to the first chambers 208*a* as shown in FIG. 9*b,* the checking ball 230 closes the opening end of the radial passages 229 and thereby the damping effect is obtained. Therefore, as shown in FIG. 9*c,* the rotor 204 is smoothly rotated relative to the housing member 205. According to this embodiment, it is able to obtain the same effect as the second embodiment.

In the above mentioned first to fourth embodiments, the locking mechanism connects the rotor with the housing member when the valve timing control device is in the maximum retarded condition. However, it is able to connect the rotor with the housing member when the valve timing control device is in the maximum advanced condition. In this case, a spring whose biasing force is smaller than the force due to the pressure in the chamber is disposed between the rotor and the housing member so that the valve timing control device is shifted to the maximum advanced condition by the spring when the pressure in the chamber decreases.

Figure 10:
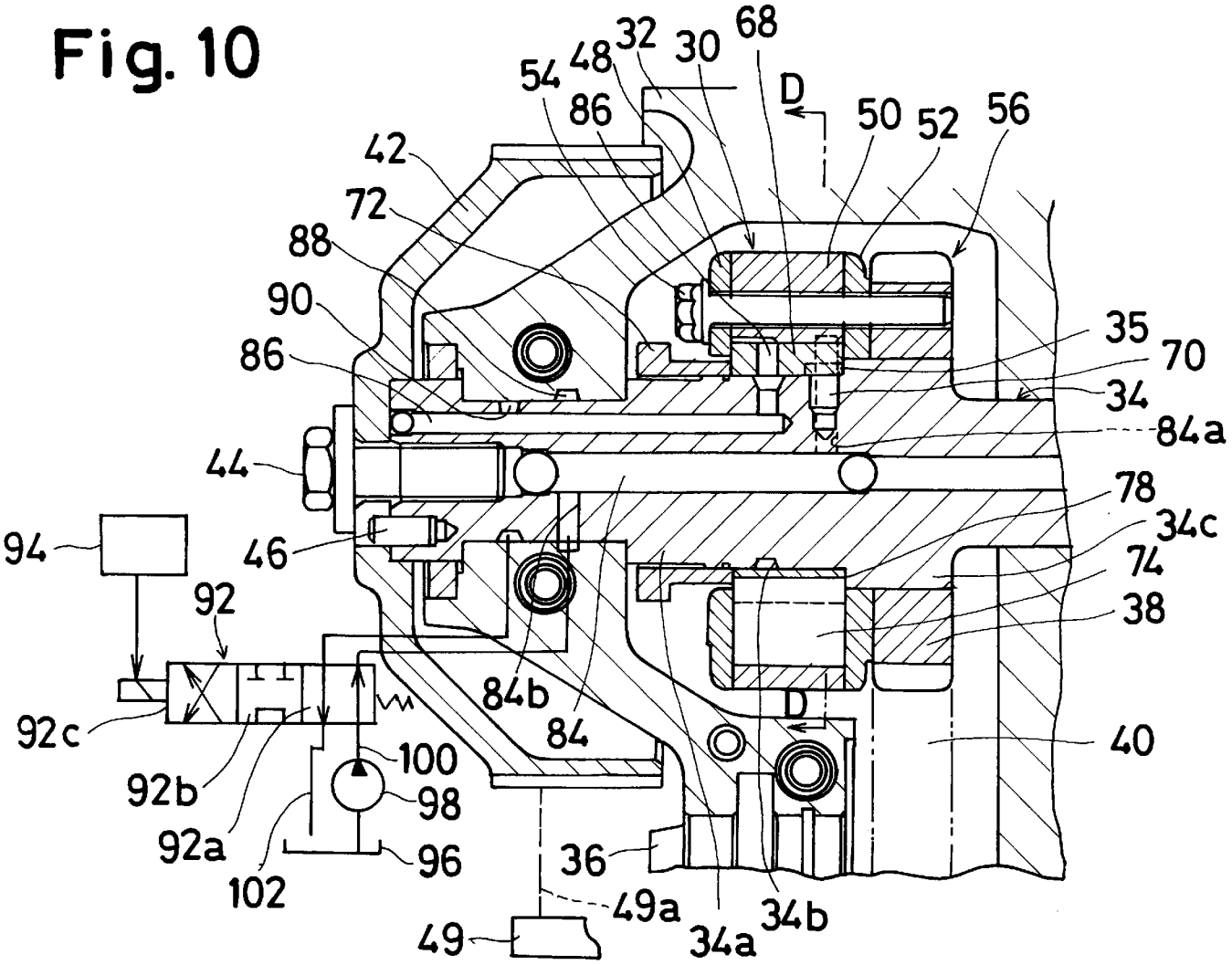
FIG. 10 shows a sectional view of a fifth embodiment of a valve timing control device in accordance with the present invention.
Figure 11:
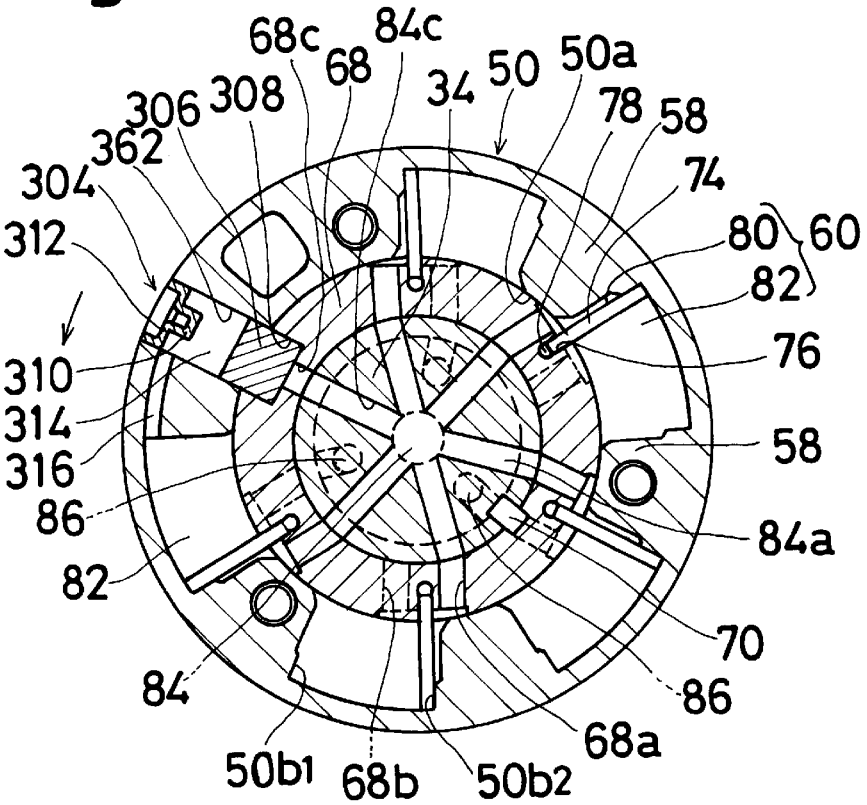
FIG. 11 shows a cross-sectional view taken on line D—D of FIG. 10 and shows a maximum retarded condition thereof at the running of an engine.
Figure 12:
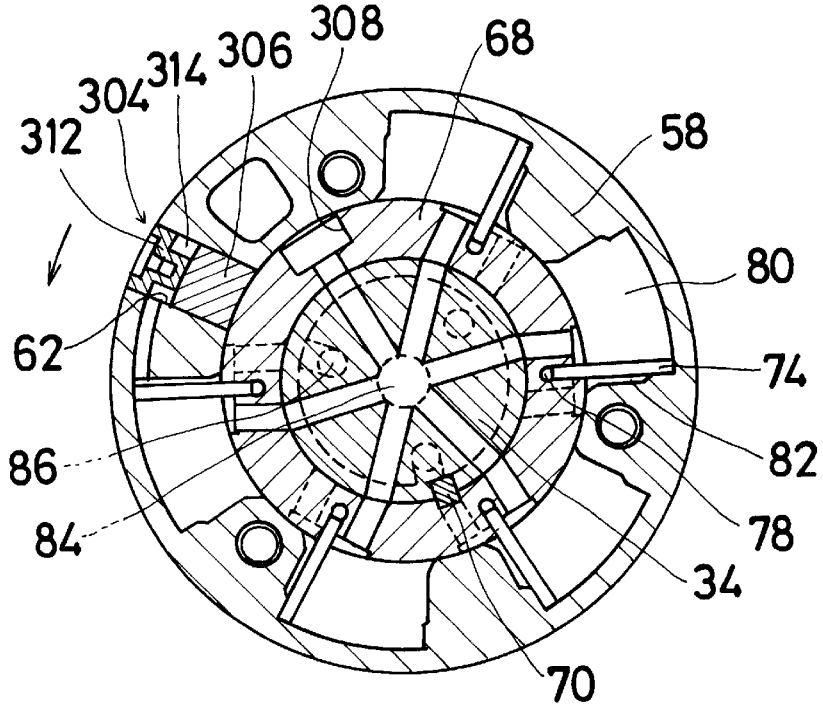
FIG. 12 shows a cross-sectional view taken on line D—D of FIG. 10 and shows a maximum advanced condition thereof at the running of an engine.
Figure 13:
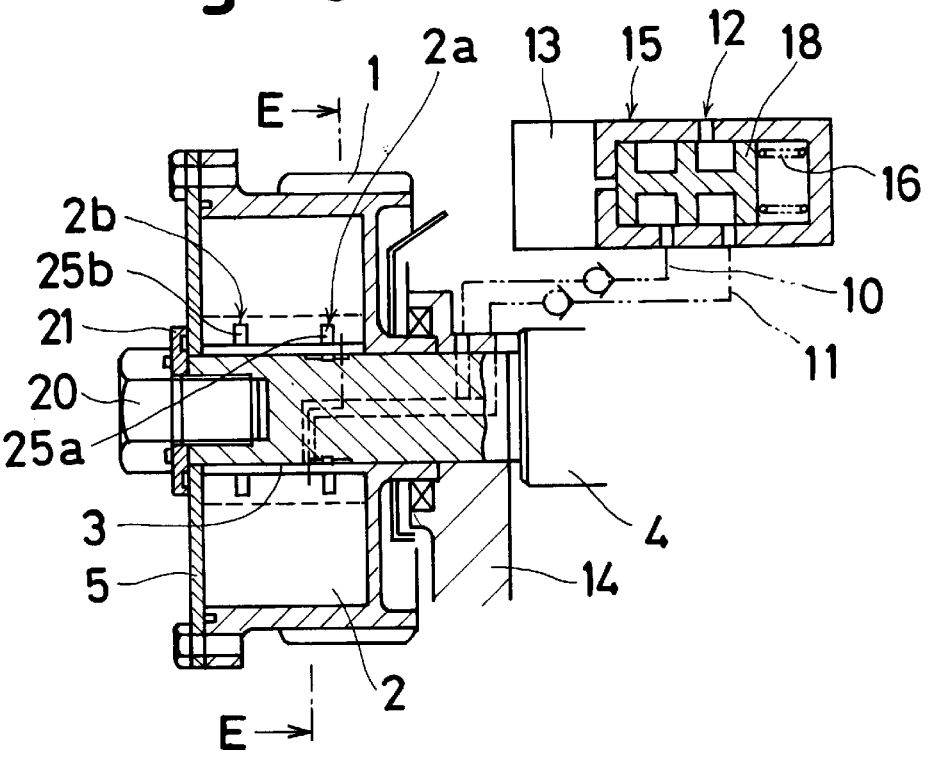
Fig. 13 Prior Art
FIG. 13 shows a sectional view of the prior device.
Figure 14:
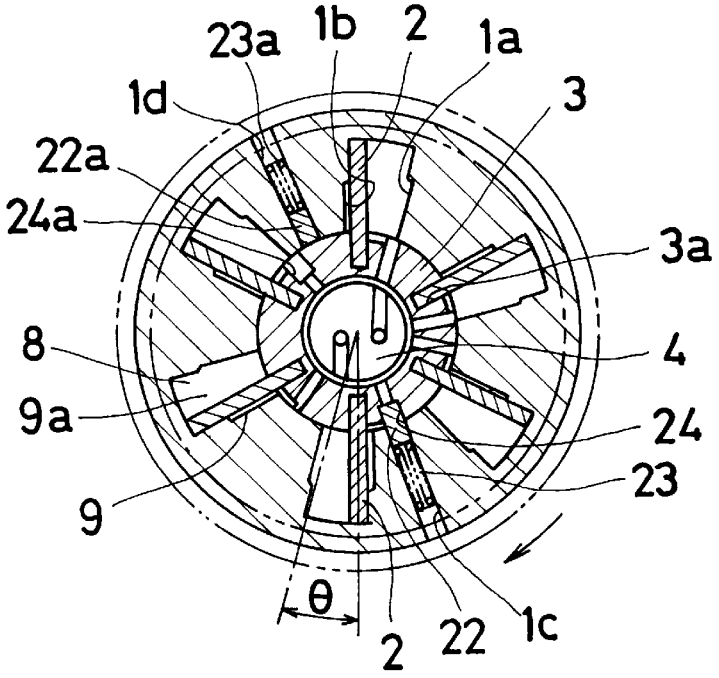
Fig. 14 Prior Art
FIG. 14 shows a cross-sectional view taken on line E—E of FIG. 10.

FIG. 10 to FIG. 12 show a fifth embodiment of the present invention. In FIG. 10 to FIG. 12, the same parts as compared with FIG. 1 to FIG. 4 are identified by the same reference numerals.

Referring to FIG. 10, since the structures shown in FIG. 10 are the same as that shown in FIG. 1, the descriptions thereof are omitted. Referring to FIG. 11 and FIG. 12, a locking mechanism 304 is disposed between the rotor 68 and the housing member 50. The locking mechanism 304 includes a receiving hole 308 which is formed on the outer circumferential portion of the rotor 68, a canceling hole 362 which is formed on the inner circumferential portion of the housing member 50 so as to be able to align with the receiving hole 308 and a stepped locking pin 306 which is slidably fitted into the canceling hole 362. The canceling hole 362 has a diameter which is almost the same as that of the locking pin 306. The receiving hole 308 has a diameter which is almost the same as that of the canceling hole 362 or is slightly smaller than that of the canceling hole 362. In this embodiment, the receiving hole 308 is aligned with the canceling hole 362 when the valve timing control device is in a maximum retarded condition in which the vanes 74 contact with the walls 50*b*2, respectively. The receiving hole 308 is communicated to the passage 84 via radial holes 68*c,* 84*c* which are formed on the rotor 68 and the cam shaft 34, respectively and therefore a part of the fluid which is supplied to the first pressure chambers 80 is supplied. In the radially outer end portion of the canceling hole 362, a cover 312 having a stepped portion 310 is fluid tightly fixed therein so that the fluid is not leaked outside of the canceling hole 362. An inner space 314 of the canceling hole 362 communicates with the adjacent second pressure chamber 82 via a passage 316 formed on the housing member 50. Therefore, the locking pin 306 is urged from both sides by the fluid pressure of the passage 84 and the fluid pressure of the passage 86 via the second pressure chamber 82 and is slid in the radial direction by the pressure difference. Now, the passage 316 may be formed between a concave portion (groove) formed on axial surface of the housing member 50 and the front plate 48 or the rear plate 52.

The operation of the valve timing control device having the above structure will now be described.

According to this embodiment, as described in the first embodiment, the opening and closing timing of the intake valves (not shown) driven by the intake cam shaft 36 is adjusted and the angular phase difference between the crank shaft 49 and the intake cam shaft 36 is adjusted.

According to this embodiment, when the pressurized fluid is supplied to the passage 86 and the fluid in the passage 84 is released by the changeover valve 92, the housing member 50 is rotated clockwise relative to the rotor 68 in FIG. 12. Then, when the receiving hole 308 is aligned with the canceling hole 362, the locking pin 306 is fitted into the receiving hole 308 by the fluid pressure in the second chambers 82 and the housing member 50 and the rotor 68 are connected with each other. Further, when the pressurized fluid is supplied to the passage 84 and the fluid in the passage 86 is released by the changeover valve 92, the locking pin 306 is pushed out from the receiving hole 308 by the fluid pressure in the passage 84 and the housing member 50 is rotated counterclockwise relative to the rotor 68. At this time, the locking pin 306 contacts with the stepped portion 310 of the cover 312 and is located between the stepped portion 310 and the rotor 68 in the radial direction shown in FIG. 12. In this embodiment, even though the fluid from the passage 86 is leaked from the receiving hole 308 to the inner space 314 via the clearance between the locking pin 306 and the canceling hole 362 or the clearance between the locking pin 306 and the receiving hole 308, the leaked fluid is returned to the passage 86 via the second pressure chamber 82. Therefore, it is not necessary to discharge the leaked fluid outside of the canceling hole 362. Therefore, even if the rotational torque is transmitted from the crank shaft to the timing pulley by a timing belt made of resin or rubber, the timing belt and the transmitting efficiency between the timing pulley and the timing belt is not deteriorated by the leaked fluid. Further, since the locking pin 306 is located between the stepped portion 310 and the rotor 68 in the canceling hole 362, even if the rotational speed of the housing member 50 changes, it is prevented that the locking pin 306 vibrates in the radial direction. Furthermore, since the passage 316 is opened into a portion of the inner space 316 which is positioned radially outer than the stepped portion 310, the inner space 314 is kept about the stepped portion 310 and therefore the fluid pressure from the passage 86 is surely acted on the locking pin 306.

The principles, preferred embodiments and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A valve timing control device comprising:

a rotor fixed on a cam shaft, a housing member rotatable mounted on the cam shaft so as to surround the rotor, a chamber defined between the housing member and the rotor and having a pair of circumferentially opposed walls, a vane mounted on the rotor and extended outwardly therefrom in the radial direction into the chamber so as to divide the chamber into a first pressure chamber and a second pressure chamber, said vane being further slidably mounted so as to be movably positioned between one of a first position, a second position and at least one intermediate position, a fluid supplying means for supplying fluid under pressure to at least a selected one of the first pressure chamber and the second pressure chamber, wherein the fluid supplying means includes a first passage means for supplying fluid under pressure into the first pressure chamber, and a second fluid passage means for supplying fluid under pressure into the second pressure chamber, a locking means for lockingly connecting the housing member with the rotor when the vane is located in the first position, wherein said locking means comprises a pair of radially aligned holes formed in the housing member and the rotor respectively, and a locking pin slidably received in one of the radially aligned holes but urged by a spring to extend from said one hole into the other of the aligned holes, and a canceling means for canceling the locking means and for maintaining the locking means canceled by the fluid pressure of the fluid supplying means such that the vane is movably positionable to the second position and the at least one intermediate position, wherein the canceling means comprises a third passage means for supplying fluid under pressure to said other hole before the holes are aligned with each other.

2. A valve timing control device recited in claim 1, wherein the third passage means includes an orifice.

3. A valve timing control device comprising:

a rotor fixed on a cam shaft, a housing member rotatably mounted on the cam shaft so as to surround the rotor, a chamber defined between the housing member and the rotor and having a pair of circumferentially opposed walls, a vane provided on the rotor and extended outwardly therefrom in the radial direction into the chamber so as to divide the chamber into a first pressure chamber and a second pressure chamber, said vane being movably positionable via the rotor between one of a first position, a second position and at least one intermediate position, a fluid supplying means for supplying fluid under pressure to at least a selected one of the first pressure chamber and the second pressure chamber, wherein the fluid supplying means includes a first passage means for supplying fluid under pressure into the first pressure chamber, and a second fluid passage means for supplying fluid under pressure into the second pressure chamber, a locking means for lockingly connecting the housing member with the rotor, wherein the locking means comprises a pair of radially aligned holes formed in the housing member and the rotor respectively, and a locking pin slidably received in one of the radially aligned holes but urged by a spring to extend from said one hole into the other of the aligned holes, and a canceling means for canceling the locking means and for maintaining the locking means canceled in response to the fluid pressure of the fluid supplying means such that the vane is movably positionable to the second position and the at least one intermediate position, wherein the canceling means comprises a third passage means for supplying fluid under pressure to said other hole before the holes are aligned with each other.

* * * * *